US009592594B2

(12) United States Patent
Chen

(10) Patent No.: US 9,592,594 B2
(45) Date of Patent: Mar. 14, 2017

(54) SOCKET WRENCH WITH RETAINING MECHANISM

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 252 days.

(21) Appl. No.: 14/254,870

(22) Filed: Apr. 16, 2014

(65) Prior Publication Data

US 2015/0298304 A1 Oct. 22, 2015

(51) Int. Cl.
*B25B 23/10* (2006.01)
*B25B 13/06* (2006.01)
*B25B 23/00* (2006.01)

(52) U.S. Cl.
CPC ..... *B25B 23/108* (2013.01); *B25B 13/06* (2013.01); *B25B 23/0035* (2013.01)

(58) Field of Classification Search
CPC ..... B25B 23/0035; B25B 23/02; B25B 23/10; B25B 23/108; B25B 13/06; Y10T 279/17786
USPC ..... 81/125
See application file for complete search history.

(56) References Cited

U.S. PATENT DOCUMENTS 145,399 A * 12/1873 Colbert ..... B25B 13/466 411/392
2,805,594 A * 9/1957 Fogel ..... B25B 23/108 279/79
3,142,211 A * 7/1964 Faso ..... B25B 23/108 81/125
6,889,581 B2 * 5/2005 Chen ..... B25B 23/101 81/125

* cited by examiner

*Primary Examiner* — Hadi Shakeri
(74) *Attorney, Agent, or Firm* — Guice Patents PLLC

(57) ABSTRACT

A socket wrench includes a wrench body, a driving seat and a retaining ring. The driving seat disposed in a head of the wrench body, and has a central hole, an aperture defined in and through an inner wall of the central hole, and a cutout defined in an outer periphery thereof. The retaining ring mounted around the driving seat has a hook portion and a straight leg. The hook portion has a distal end extending through the aperture of the driving seat. The straight leg is rested in the cutout of the driving seat. The straight leg has a distal end extending outside the cutout. The straight leg could be operated to an open position where the distal end of the hook portion is retracted in the aperture of the driving seat.

7 Claims, 12 Drawing Sheets

SOCKET WRENCH WITH RETAINING MECHANISM

BACKGROUND OF THE INVENTION

1. Field of the Invention

The present invention relates to socket wrench, and more particularly to a socket wrench with retaining mechanism.

2. Description of Related Art

A conventional wrench tool with a retaining device comprises a body including a receiving cavity formed on at least one end thereof and a ratchet seat received in the receiving cavity of the body. The ratchet seat has a plurality of teeth arranged around an outer surface thereof and a polygonal driving hole in the ratchet seat. The driving hole has an inner wall defining a plurality of odd interior angles, a number of even interior angles, and between two adjacent interior angles of the fitting segment being provided with an adjoining wall, and the adjoining wall including two contacting faces formed on two sides thereof respectively. A ratchet device is defined between the body and the ratchet seat and engaging with the teeth of the ratchet seat. A retaining device has a flexible engaging assembly disposed on the adjoining wall and extending over the two contacting faces.

The flexible engaging assembly of the retaining device of the conventional wrench tool is formed by a spring-loaded locking ball. However, the spring-loaded locking ball may be elastic fatigue during a long-term utilization.

The present invention has arisen to mitigate and/or obviate the disadvantages of the conventional wrench tool.

SUMMARY OF THE INVENTION

The main objective of the present invention is to provide an improved socket wrench.

To achieve the objective, a socket wrench, comprises a wrench body, a driving seat and a retaining ring. The wrench body has a handle and a head. The driving seat is disposed in the head of the wrench body, and has a central hole therein, an aperture defined in and through an inner wall of the central hole of the driving seat, and a cutout defined in an outer periphery of the driving seat and in communication with the central hole of the driving seat. The retaining ring is mounted around the driving seat, and defines a hook portion and a straight leg. The hook portion has a distal end extending through the aperture of the driving seat and into the central hole of the driving seat. The straight leg is rested in the cutout of the driving seat and partially exposed in the central hole of the driving seat. The straight leg has a distal end extending outside the cutout of the driving seat. Specifically, the distal end of the straight leg is configured to be operated to drive the retaining ring to an open position where the distal end of the hook portion is retracted in the aperture of the driving seat.

Preferably, the hook portion of the retaining ring has an engaging section extending through the aperture of the driving seat and into the central hole of the driving seat, and an arcuate section defined between the engaging section and the straight leg.

Preferably, the socket wrench further comprises a switch ring mounted around the driving seat, wherein the distal end of the straight leg of the retaining ring is bent upwardly, and the switch ring has a slot for accommodating the distal end of the straight leg.

Preferably, a C-ring mounted around the driving seat to retain the switch ring. Further, the central hole of the driving seat is polygonal in shape.

Further benefits and advantages of the present invention will become apparent after a careful reading of the detailed description with appropriate reference to the accompanying drawings.

DETAILED DESCRIPTION OF THE INVENTION

Figure 1:
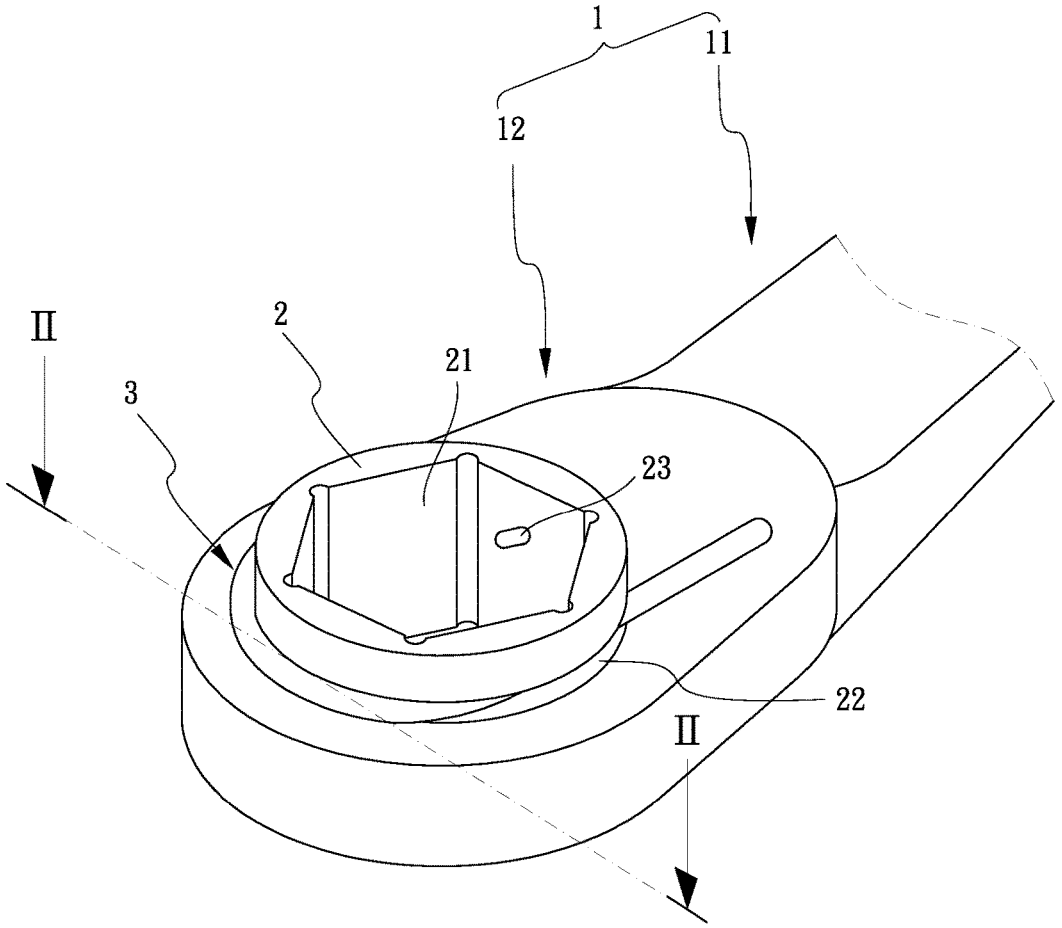
FIG. 1 is a perspective view of a socket wrench in accordance with a first embodiment of the present invention.
Figure 2:
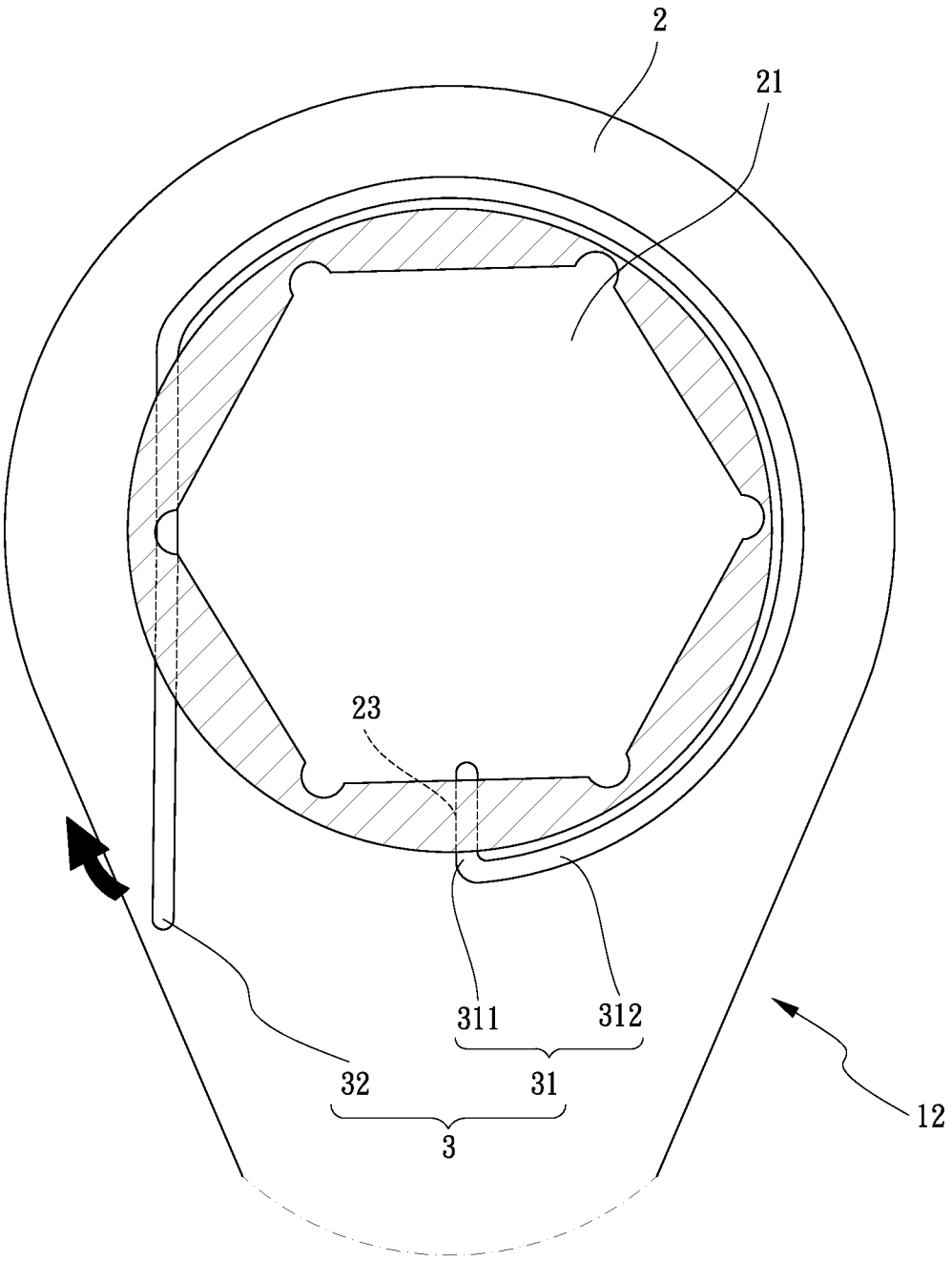
FIG. 2 is a partial cross-sectional view of the socket wrench along line II-II of FIG. 1.
Figure 3:
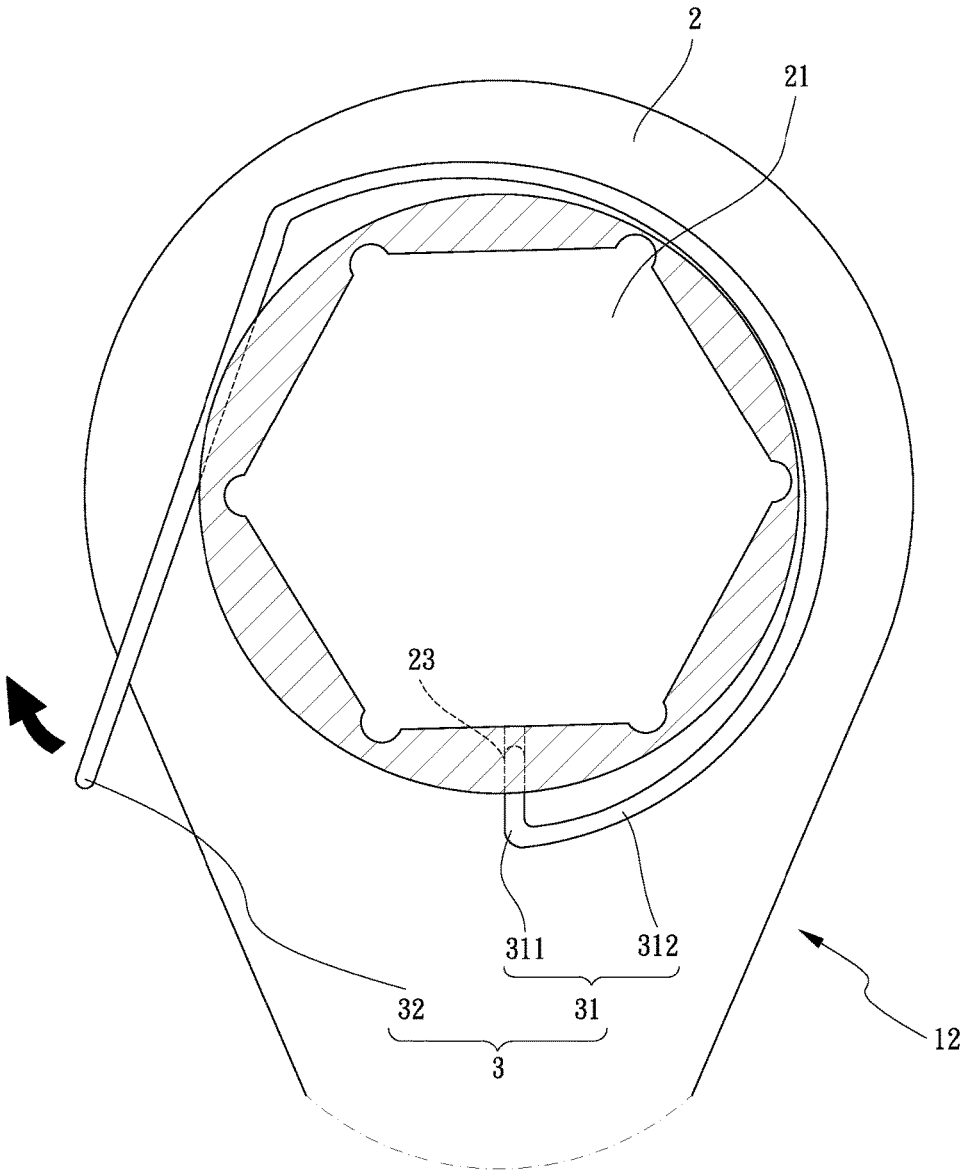
FIG. 3 illustrates the operation of the socket wrench shown in FIG. 2.

Referring to FIGS. 1-3, a socket wrench in accordance with a first embodiment of the present invention comprises a wrench body 1, a driving seat 2 and a retaining ring 3. The wrench body 1 has a handle 11 and a head 12. The driving seat 2 is disposed in the head 12 of the wrench body 1. The driving seat 2 has a central hole 21 defined therein, an aperture 23 defined in and through an inner wall of the central hole 21 of the driving seat 2, and a cutout 22 defined in an outer periphery of the driving seat 2 and in communication with the central hole 21 of the driving seat 2.

As shown in FIG. 2, the retaining ring 3 is mounted around the driving seat 2. The retaining ring 3 defines a hook portion 31 and a straight leg 32. The hook portion 31 of the retaining ring 3 has an engaging section 311 extending through the aperture 23 of the driving seat 2 and into the central hole 21 of the driving seat 2, and an arcuate section 312 defined between the engaging section 311 and the straight leg 32. Specifically, the straight leg 32 is rested in the cutout 22 of the driving seat 2 and partially exposed in the central hole 21 of the driving seat 2. The straight leg 32 has a distal end extending outside the cutout 22 of the driving seat 2, as shown in FIGS. 1-2. The distal end of the straight leg 32 is configured to be operated to drive the retaining ring 3 to an open position where the engaging section 311 of the hook portion 31 is retracted in the aperture 23 of the driving seat 2.

In operation, as shown in FIGS. 2-3, a user could pull the straight leg 32 out from the cutout 22 of the driving seat 2 while the engaging section 311 of the hook portion 31 is retracted in the aperture 23 of the driving seat 2, as shown in FIG. 3. Therefore, a socket (not shown) could be received in the central hole 21 of the driving seat 2. When the straight leg 32 of the retaining ring 3 is released, the straight leg 32 is back to rest in the cutout 22 of the driving seat 2 via a resilient restoring force of the straight leg 32. Under this arrangement, the socket could be positioned in the central hole 21 of the driving seat 2 by the engagement of the engaging section 311 of the hook portion 31 and the straight leg 32.

Figure 4:
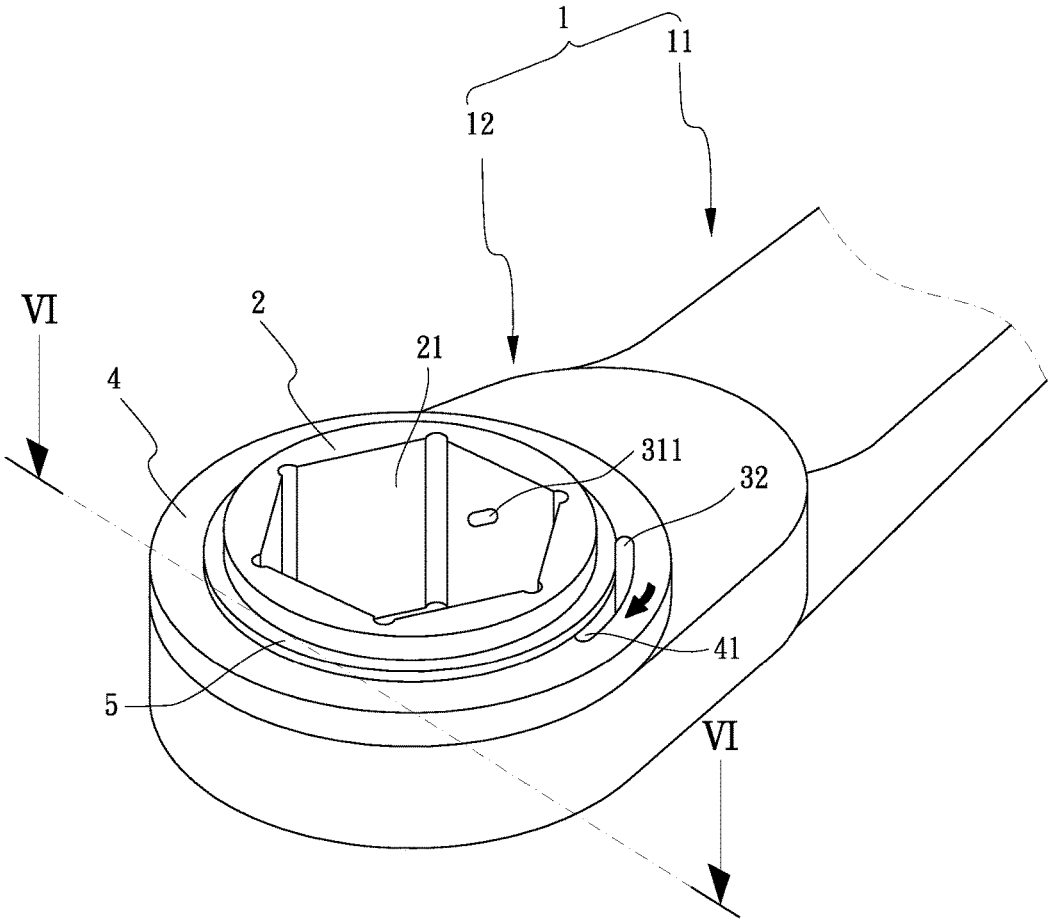
FIG. 4 is a perspective view of a socket wrench in accordance with a second embodiment of the present invention.
Figure 5:
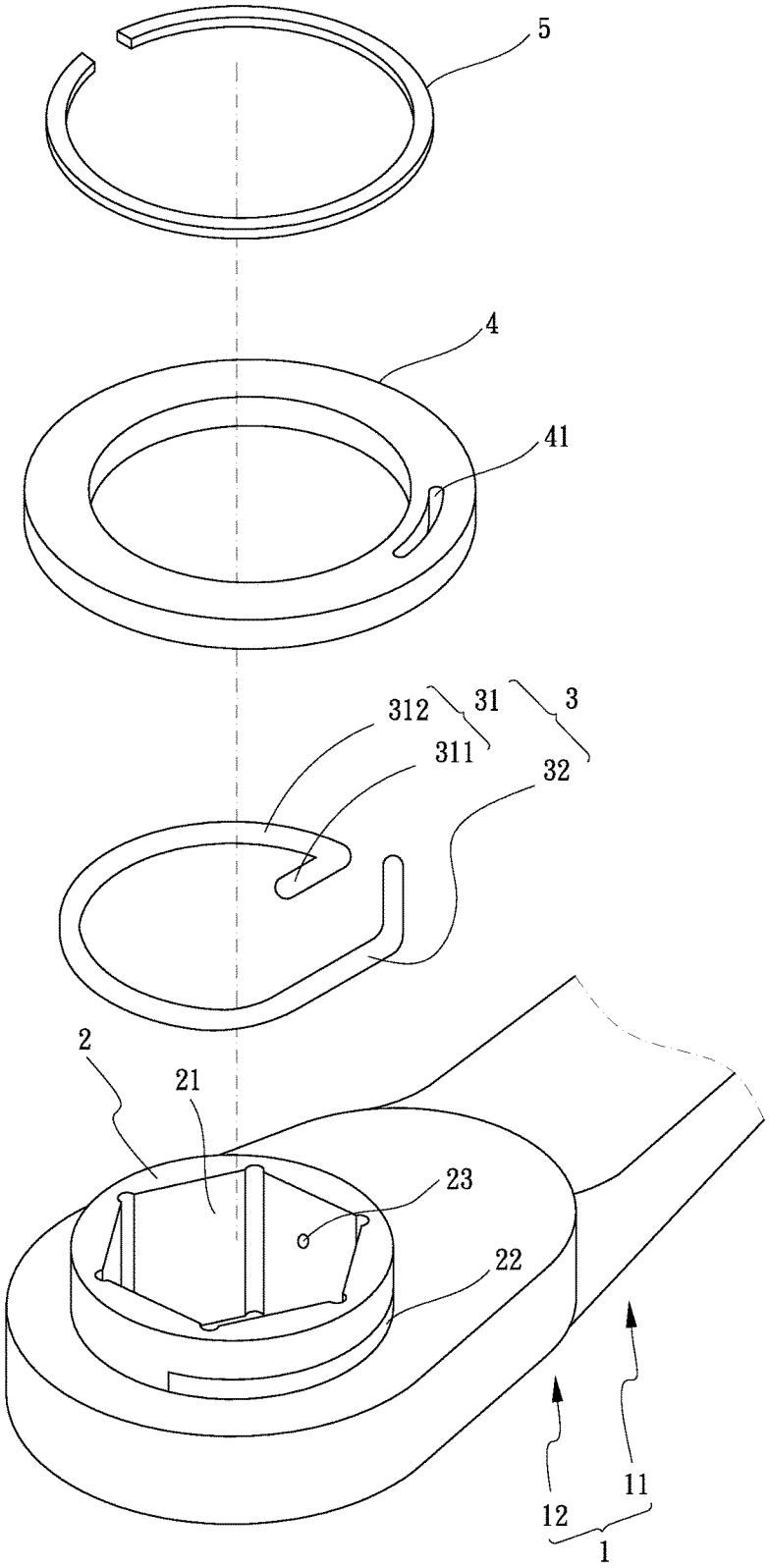
FIG. 5 is an exploded perspective view of the socket wrench shown in FIG. 4.
Figure 6:
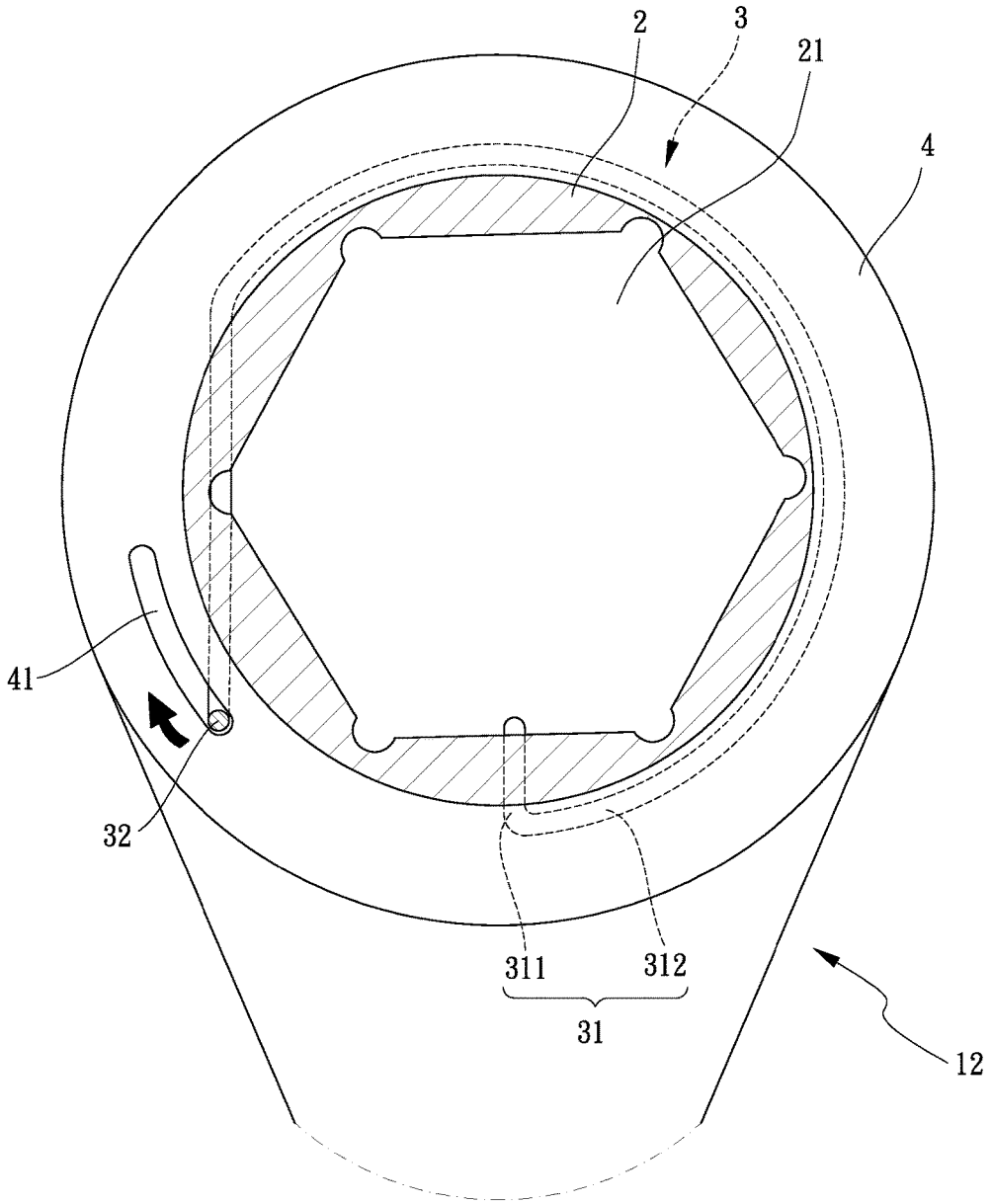
FIG. 6 is a partial cross-sectional view of the socket wrench along line VI-VI of FIG. 4.
Figure 7:
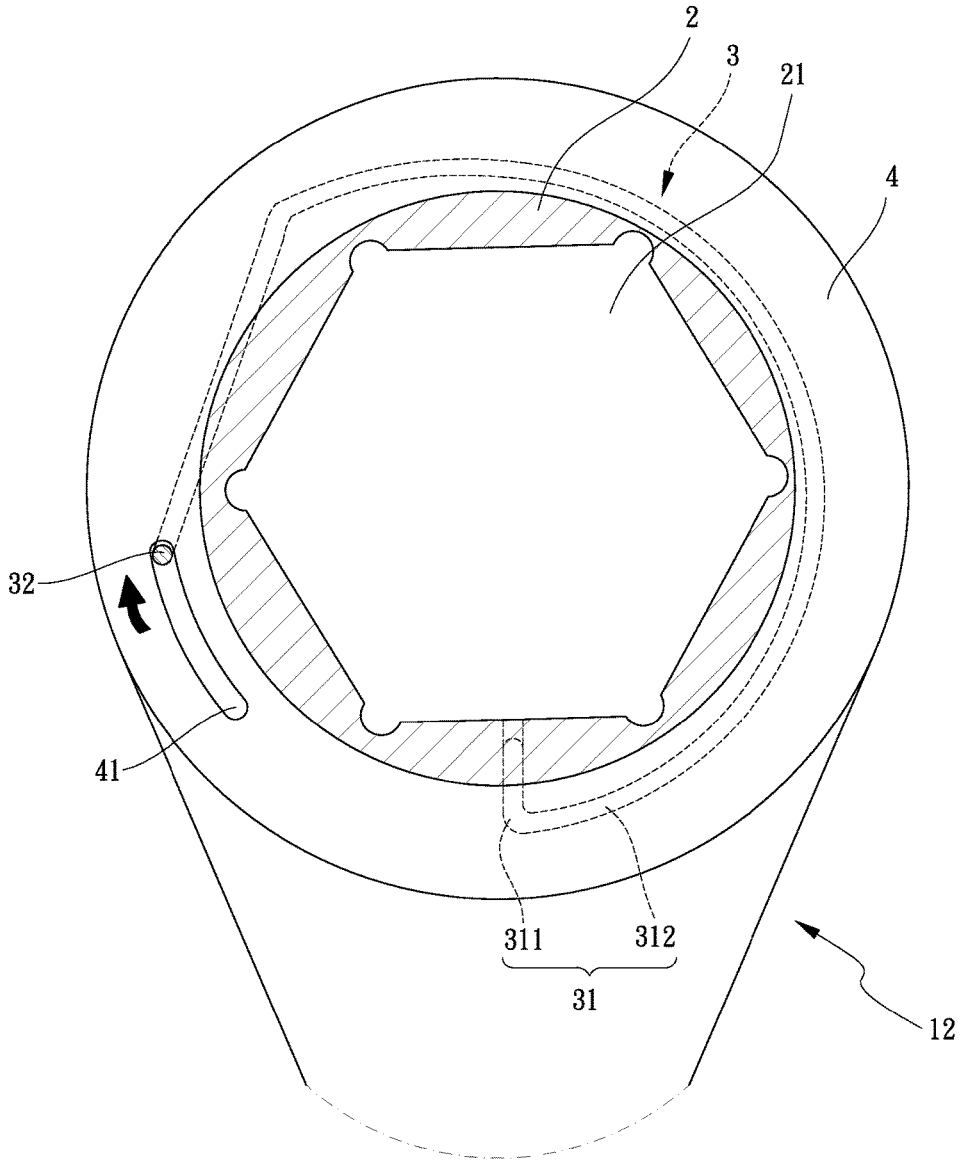
FIG. 7 illustrates the operation of the socket wrench shown in FIG. 6.
Figure 8:
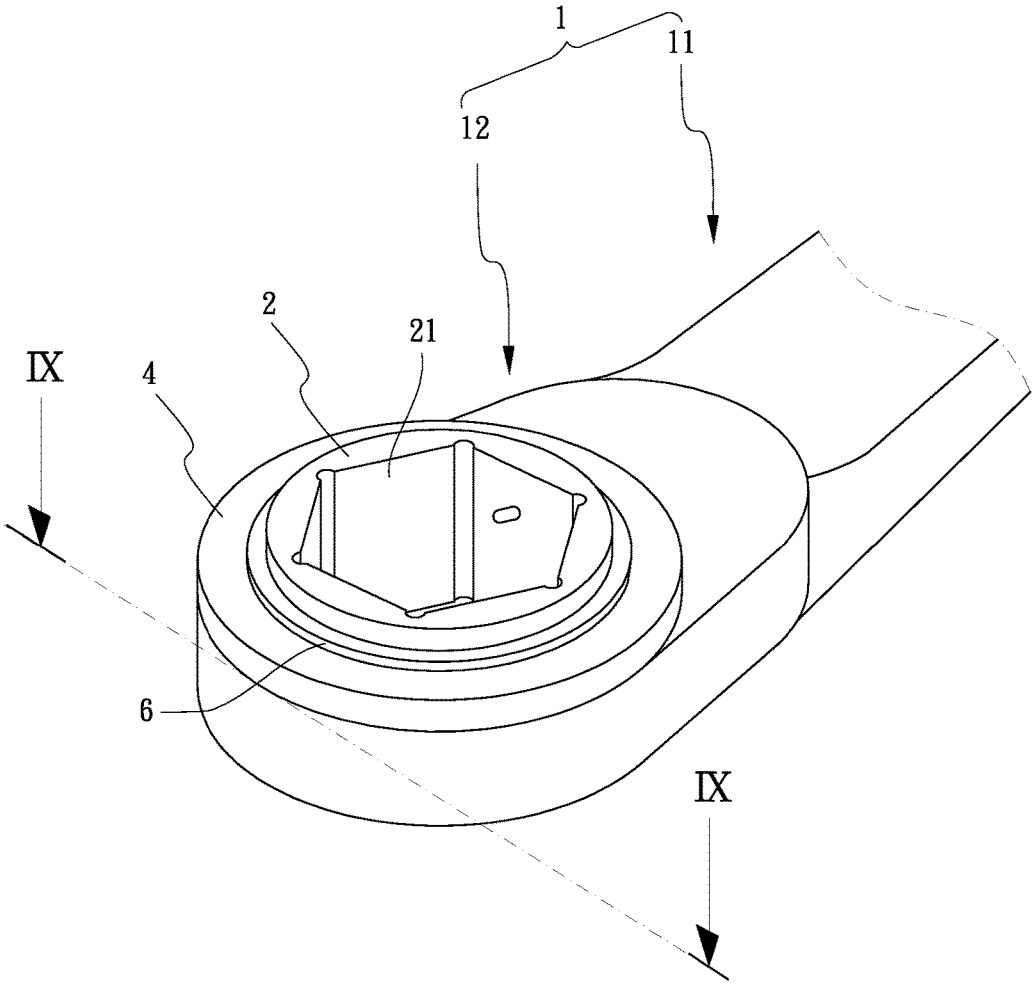
FIG. 8 is a perspective view of a socket wrench in accordance with a third embodiment of the present invention.

FIGS. 4-7 show a second embodiment of the present invention. The second embodiment is similar to the first embodiment, except that a switch ring 4 is rotatably mounted around the driving seat 2. Specifically, the distal end of the straight leg 32 of the retaining ring 3 is bent upwardly, as shown in FIG. 5. The switch ring 4 has a slot 41 for accommodating the distal end of the straight leg 32, wherein the distal end of the straight leg 32 extends through the slot 41 of the switch ring 4. The straight leg 32 is movable between an engagement position (FIG. 6) and a disengagement position (FIG. 7).

In operation, the user could push the straight leg 32 to the disengagement position while the engaging section 311 of the hook portion 31 is retracted in the aperture 23 of the driving seat 2, as shown in FIG. 7. Therefore, the socket could be received in the central hole 21 of the driving seat 2. When the distal end of the straight leg 32 is released, the straight leg 32 is back to the engagement position via a resilient restoring force of the straight leg 32. Under this arrangement, the socket could be positioned in the central hole 21 of the driving seat 2 by the engagement of the engaging section 311 of the hook portion 31 and the straight leg 32.

Referring to FIGS. 4-5, a C-ring 5 is mounted around the driving seat 2 to retain the switch ring 4. Furthermore, the central hole 21 of the driving seat 2 is polygonal in shape, such as hexagonal, double square or double hexagonal.

Figure 9:
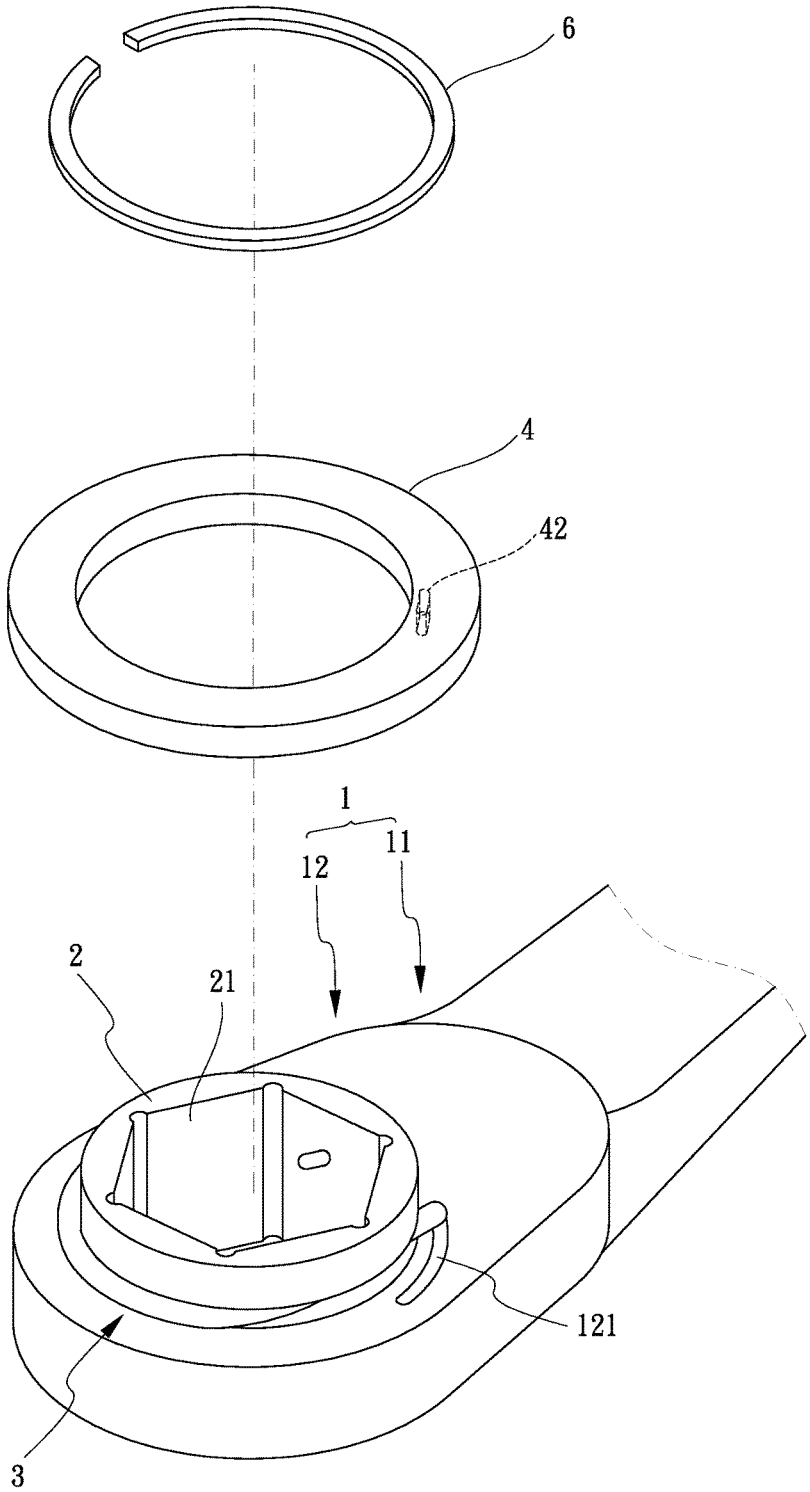
FIG. 9 is a partial exploded perspective view of the socket wrench shown in FIG. 8.
Figure 10:
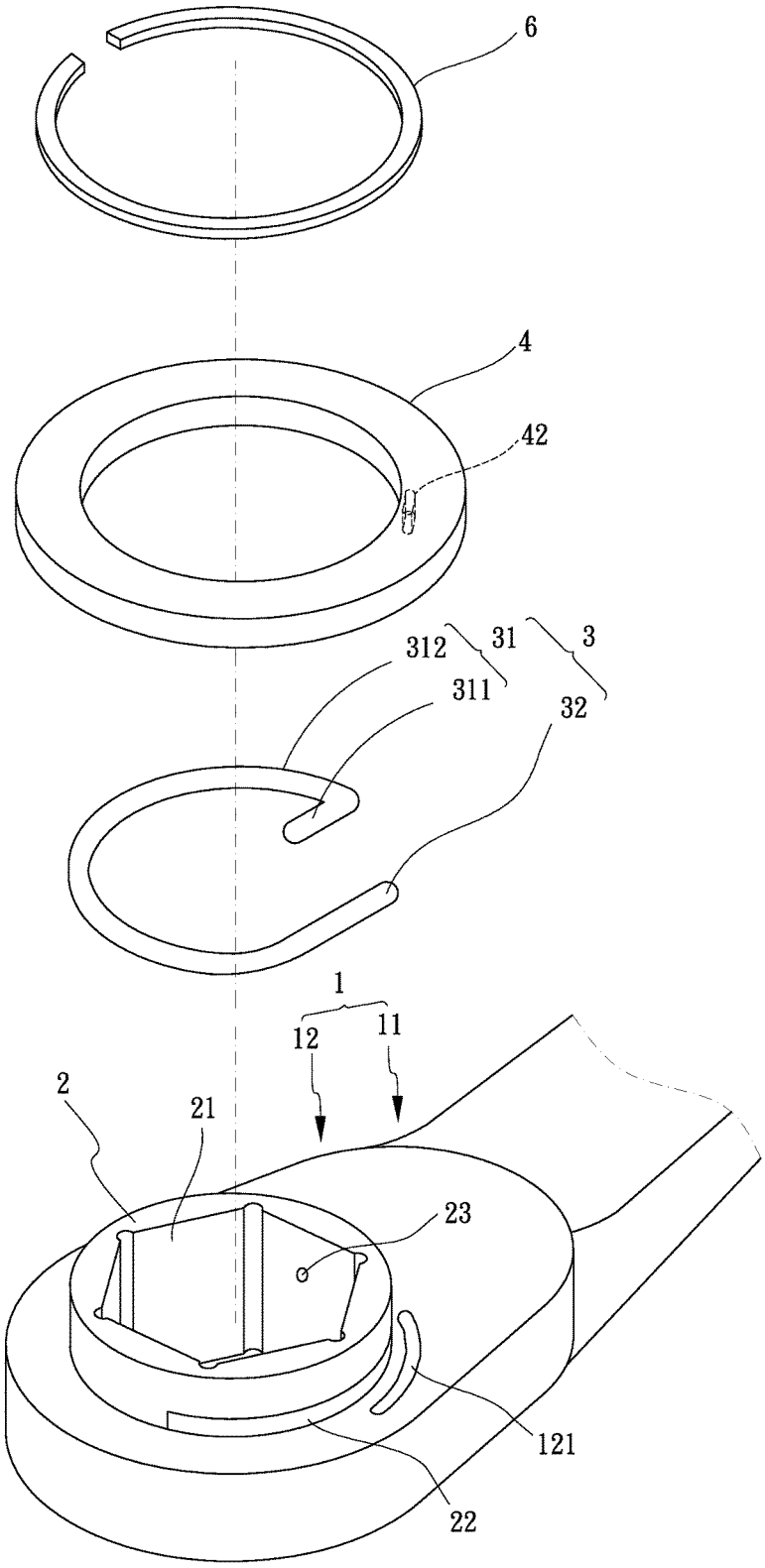
FIG. 10 is an exploded perspective view of the socket wrench shown in FIG. 8.

FIGS. 8-12 show a third embodiment of the present invention. The third embodiment is similar to the second embodiment, except for the structure of the switch ring 4. Specifically, the head 12 further has a guiding groove 121 defined in a top thereof. The straight leg 32 has a distal end extending outside the cutout 22 of the driving seat 2, as shown in FIG. 9. The switch ring 4 is rotatably mounted around the driving seat 2. The switch ring 4 has a stud 42 movably received in the guiding groove 121 of the head 12 of the wrench body 1 and abutting against the distal end of the straight leg 32.

Figure 11:
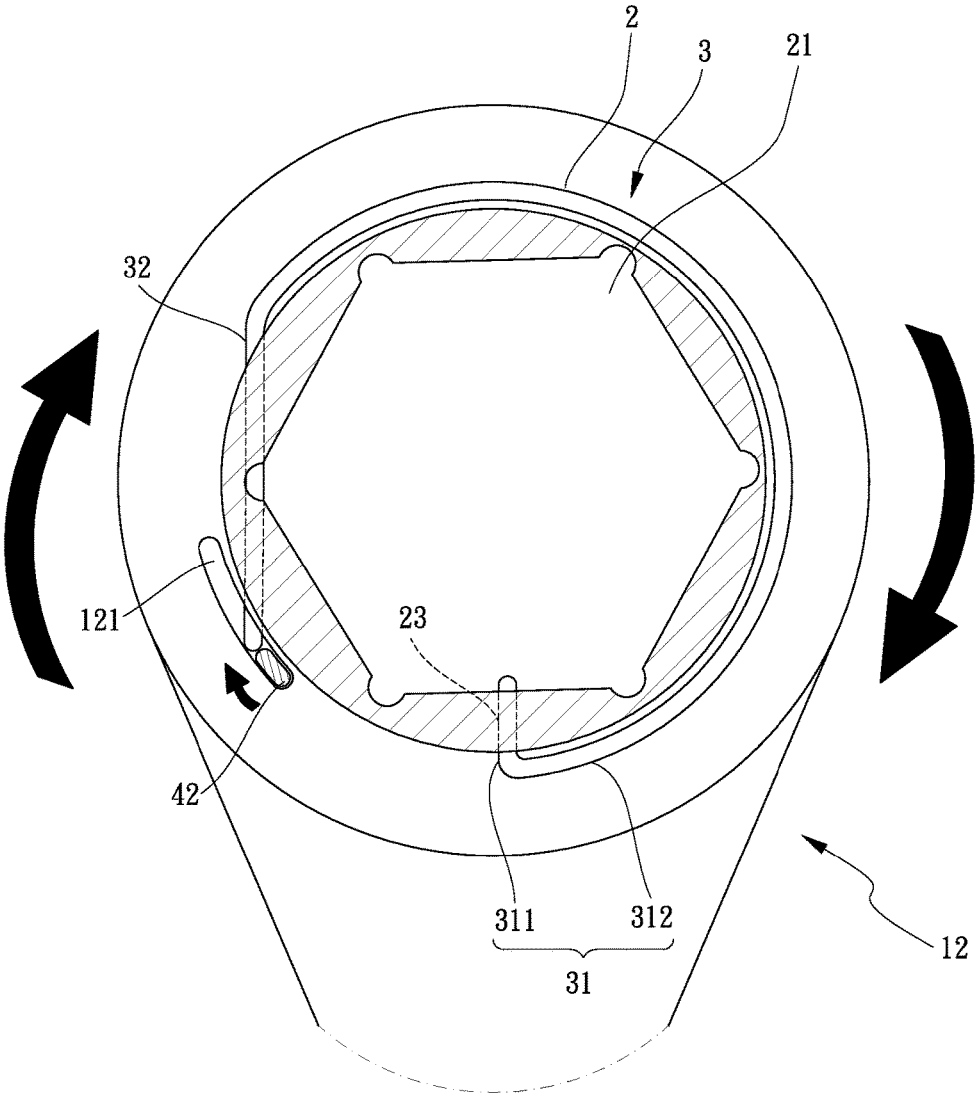
FIG. 11 is a partial cross-sectional view of the socket wrench along line XI-XI of FIG. 8.
Figure 12:
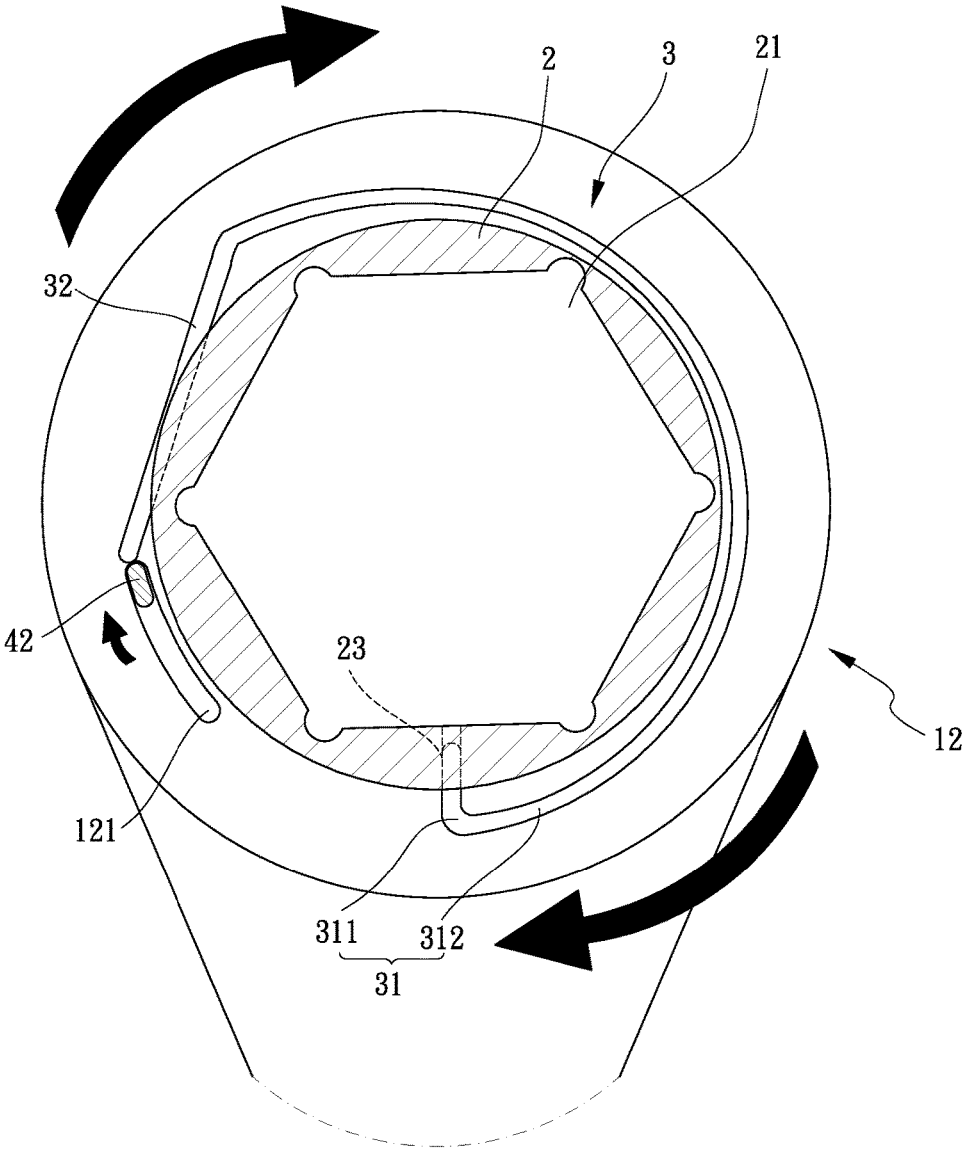
FIG. 12 illustrates the operation of the socket wrench shown in FIG. 11.

In operation, as shown in FIGS. 11-12, when the switch ring 4 is rotated to an open position, the straight leg 32 of the retaining ring 3 is pushed outward while the engaging section 311 of the hook portion 31 is retracted in the aperture 23 of the driving seat 2. Therefore, the socket could be positioned in the central hole 21 of the driving seat 2. In addition, a C-ring 6 is mounted around the driving seat 2 to retain the switch ring 4.

Although embodiments of this invention have been fully described with reference to the accompanying drawings, it is to be understood that various modifications can be made by those skilled in the art without departing from the scope of the invention as hereinafter claimed.

What is claimed is:

1. A socket wrench, comprising:

a wrench body having a handle and a head;

a driving seat disposed in the head of the wrench body, and having a central hole, an aperture defined in and through an inner wall of the central hole of the driving seat, and a cutout defined in an outer periphery of the driving seat and in communication with the central hole of the driving seat, a switch ring mounted around the driving seat and having a slot;

a retaining ring mounted around the driving seat, and defining a hook portion and a straight leg, the hook portion having a distal end extending through the aperture of the driving seat and into the central hole of the driving seat, the straight leg rested in the cutout of the driving seat and partially exposed in the central hole of the driving seat, the straight leg having a distal end which is bent upward and extends outside the cutout of the driving seat, the distal end of the straight leg being accommodated in the slot of the switch ring, the distal end of the straight leg configured to be operated to drive the retaining ring to an open position where the distal end of the hook portion is retracted in the aperture of the driving seat, and a C-ring mounted around the driving seat to retain the switch ring.

2. The socket wrench as claimed in claimed 1, wherein the hook portion of the retaining ring has an engaging section extending through the aperture of the driving seat and into the central hole of the driving seat, and an arcuate section defined between the engaging section and the straight leg.

3. The socket wrench as claimed in claim 1, wherein the central hole of the driving seat is polygonal in shape.

4. A socket wrench, comprising:

a wrench body having a handle and a head, the head having a guiding groove defined in a top thereof;

a driving seat disposed in the head of the wrench body, and having a central hole, an aperture defined in and through an inner wall of the central hole of the driving seat, and a cutout defined in an outer periphery of the driving seat and in communication with the central hole of the driving seat;

a retaining ring mounted around the driving seat, and defining a hook portion and a straight leg, the hook portion having a distal end extending through the aperture of the driving seat and into the central hole of the driving seat, the straight leg rested in the cutout of the driving seat and partially exposed in the central hole of the driving seat, and the straight leg having a distal end extending outside the cutout of the driving seat; and a switch ring rotatably mounted around the driving seat, and having a stud movably received in the guiding groove of the head of the wrench body and abutting against the distal end of the straight leg; wherein when the switch ring is rotated to an open position, the straight leg of the retaining ring is pushed outward while the distal end of the hook portion is retracted in the aperture of the driving seat.

5. The socket wrench as claimed in claimed 4, wherein the hook portion of the retaining ring has an engaging section extending through the aperture of the driving seat and into the central hole of the driving seat, and an arcuate section defined between the engaging section and the straight leg.

6. The socket wrench as claimed in claim 4, further comprising a C-ring mounted around the driving seat to retain the switch ring.

7. The socket wrench as claimed in claim 4, wherein the central hole of the driving seat is polygonal in shape.

* * * * *